US010731422B2

(12) United States Patent
Azar et al.

(10) Patent No.: US 10,731,422 B2
(45) Date of Patent: Aug. 4, 2020

(54) HYBRID CUTTING STRUCTURES WITH BLADE UNDULATIONS

(71) Applicant: Smith International, Inc., Houston, TX (US)

(72) Inventors: Michael George Azar, The Woodlands, TX (US); Scott D. McDonough, The Woodlands, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 0 days.

(21) Appl. No.: 16/207,363

(22) Filed: Dec. 3, 2018

(65) Prior Publication Data

US 2019/0106942 A1 Apr. 11, 2019

Related U.S. Application Data

(63) Continuation of application No. 14/832,705, filed on Aug. 21, 2015, now Pat. No. 10,145,180.

(60) Provisional application No. 62/042,088, filed on Aug. 26, 2014.

(51) Int. Cl.

| | |
|---|---|
| ***E21B 10/43*** | (2006.01) |
| ***E21B 10/54*** | (2006.01) |
| ***E21B 10/26*** | (2006.01) |
| *E21B 10/42* | (2006.01) |

(52) U.S. Cl.

CPC ..... *E21B 10/54* (2013.01); *E21B 10/26* (2013.01); *E21B 10/43* (2013.01); *E21B 2010/425* (2013.01)

(58) Field of Classification Search

CPC ..... E21B 10/43

See application file for complete search history.

(56) References Cited

U.S. PATENT DOCUMENTS

| | | | | |
|---|---|---|---|---|
| 6,408,958 | B1 * | 6/2002 | Isbell | E21B 10/43 175/431 |
| 7,703,559 | B2 | 4/2010 | Shen et al. | |
| 8,091,655 | B2 | 1/2012 | Shen et al. | |
| 8,127,863 | B2 | 3/2012 | Durairajan et al. | |
| 8,191,657 | B2 | 6/2012 | Richert et al. | |
| 9,145,742 | B2 | 9/2015 | Hall et al. | |
| 10,145,180 | B2 | 12/2018 | Azar et al. | |
| 2008/0035380 | A1 | 2/2008 | Hall et al. | |
| 2008/0173482 | A1 | 7/2008 | Hall et al. | |
| 2011/0061943 | A1 | 3/2011 | Richert | |
| 2011/0155472 | A1 | 6/2011 | Lyons et al. | |
| 2011/0192651 | A1 | 8/2011 | Lyons et al. | |
| 2012/0132471 | A1 | 5/2012 | Zhang et al. | |
| 2012/0205163 | A1 | 8/2012 | Azar et al. | |

(Continued)

OTHER PUBLICATIONS

International Search Report issued in International Patent Application No. PCT/US2015/046504 dated Oct. 30, 2015, 6 pages.

(Continued)

*Primary Examiner* — Giovanna Wright

(57) ABSTRACT

A downhole cutting tool may include tool body; a first blade extending from the tool body; a plurality of cutting elements attached to the first blade, the plurality of cutting elements comprising at least two types of cutting elements, wherein the first blade extends from the tool body to a first height adjacent a first type of cutting element and a second height, different from the first height, adjacent a second type of cutting element.

12 Claims, 10 Drawing Sheets

(56) References Cited

U.S. PATENT DOCUMENTS

| | | | |
|---|---|---|---|
| 2012/0234610 | A1 | 9/2012 | Azar et al. |
| 2013/0020134 | A1 | 1/2013 | Azar et al. |
| 2014/0054094 | A1 | 2/2014 | Burhan et al. |

OTHER PUBLICATIONS

Written Opinion issued in International Patent Application No. PCT/US2015/046504 dated Oct. 30, 2015, 8 pages.
International Preliminary Report on Patentability issued in International Patent Application No. PCT/US2015/046504, dated Feb. 28, 2017, 9 pages.

* cited by examiner

HYBRID CUTTING STRUCTURES WITH BLADE UNDULATIONS

CROSS REFERENCE TO RELATED APPLICATIONS

This application is a continuation of U.S. patent application Ser. No. 14/832,705, filed Aug. 21, 2015, which claims priority to and the benefit of U.S. Patent Application No. 62/042,088, filed on Aug. 26, 2014, the entireties of which are incorporated herein by reference.

BACKGROUND

In drilling a borehole in the earth, such as for the recovery of hydrocarbons or for other applications, it is conventional practice to connect a drill bit on the lower end of an assembly of drill pipe sections that are connected end-to-end so as to form a "drill string." The bit is rotated by rotating the drill string at the surface or by actuation of downhole motors or turbines, or by both methods. With weight applied to the drill string, the rotating bit engages the earthen formation causing the bit to cut through the formation material by either abrasion, fracturing, or shearing action, or through a combination of cutting methods, thereby forming a borehole along a predetermined path toward a target zone.

Many different types of drill bits have been developed and found useful in drilling such boreholes. Two predominate types of drill bits are roller cone bits and fixed cutter (or rotary drag) bits. Most fixed cutter bit designs include a plurality of blades angularly spaced about the bit face. The blades project radially outward from the bit body and form flow channels therebetween. In addition, cutting elements are typically grouped and mounted on several blades in radially extending rows. The configuration or layout of the cutting elements on the blades may vary widely, depending on a number of factors such as the formation to be drilled.

The cutting elements disposed on the blades of a fixed cutter bit are conventionally formed of extremely hard materials. In a conventional fixed cutter bit, each cutting element has an elongate and generally cylindrical tungsten carbide substrate that is received and secured in a pocked formed in the surface of one of the blades. The cutting elements also generally include a hard cutting layer of polycrystalline diamond (PCD) or other superabrasive materials such as thermally stable diamond or polycrystalline cubic boron nitride. For convenience, as used herein, reference to "PDC bit" or "PDC cutters" refers to a fixed cutter bit or cutting element employing a hard cutting layer of polycrystalline diamond or other superabrasive materials.

Referring to FIGS. 1 and 2, a conventional fixed cutter or drag bit 10 adapted for drilling through formations of rock to form a borehole is shown. Bit 10 generally includes a bit body 12, a shank 13, and a threaded connection or pin 14 for connecting the bit 10 to a drill string (not shown) that is employed to rotate the bit in order to drill the borehole. Bit face 20 supports a bladed cutting structure 15 and is formed on the end of the bit 10 that is opposite pin end 16. Bit 10 further includes a central axis 11 about which bit 10 rotates in the cutting direction represented by arrow 18.

Cutting structure 15 is provided on face 20 of bit 10. Cutting structure 15 includes a plurality of angularly spaced-apart primary blades 31, 32, 33, and secondary blades 34, 35, 36, each of which extends from bit face 20. Primary blades 31, 32, 33 and secondary blades 34, 35, 36 extend generally radially along bit face 20 and then axially along a portion of the periphery of bit 10. However, secondary blades 34, 35, 36 extend radially along bit face 20 from a position that is distal bit axis 11 toward the periphery of bit 10. Thus, as used herein, "secondary blade" may be used to refer to a blade that begins at some distance from the bit axis and extends generally radially along the bit face to the periphery of the bit. Primary blades 31, 32, 33 and secondary blades 34, 35, 36 are separated by drilling fluid flow courses 19.

Referring still to FIGS. 1 and 2, each primary blade 31, 32, 33 includes blade tops 42 for mounting a plurality of cutting elements, and each secondary blade 34, 35, 36 includes blade tops 52 for mounting a plurality of cutting elements. In particular, cutting elements 40, each having a cutting face 44, are mounted in pockets formed in blade tops 42, 52 of each primary blade 31, 32, 33 and each secondary blade 34, 35, 36, respectively. Cutting elements 40 are arranged adjacent one another in a radially extending row proximal the leading edge of each primary blade 31, 32, 33 and each secondary blade 34, 35, 36. Each cutting face 44 has an outermost cutting tip **44*a* furthest from blade tops 42, 52 to which cutting element 40** is mounted.

As shown in FIGS. 1 and 2, each gage pad 51 includes a generally gage-facing surface 60 and a generally forward-facing surface 61 which intersect in an edge 63, which may be radiused, beveled or otherwise rounded. Gage-facing surface 60 includes at least a portion that extends in a direction generally parallel to bit axis 11 and extends to full gage diameter. Other portions of gage-facing surface 60 may also be angled, and thus slant away from the borehole sidewall. Also, forward-facing surface 61 may be angled relative to central axis 11 (both as viewed perpendicular to central axis 11 or as viewed along central axis 11). Surface 61 is termed generally "forward-facing" to distinguish that surface from the gage surface 60, which generally faces the borehole sidewall. Gage-facing surface 60 of gage pads 51 abut the sidewall of the borehole during drilling. At least some gage pads 51 may include cutting elements. No gage pads 51 may be provided on bit 10. Wear-resistant inserts may be embedded in gage pads 51 and protrude from the gage-facing surface 60 or forward facing, surface 61 of gage pads 51.

Referring now to FIG. 3, a profile of bit 10 is shown as it would appear with each blade (e.g., primary blades 31, 32, 33 and secondary blades 34, 35, 36) and cutting faces 44 of each cutting element 40 rotated into a single rotated profile. In rotated profile view, blade tops 42, 52 of blades 31-36 of bit 10 form and define a combined or composite blade profile 39 that extends radially from bit axis 11 to outer radius 23 of bit 10. Thus, as used herein, the phrase "composite blade profile" refers to the profile, extending from the bit axis to the outer radius of the bit, formed by the blade tops of each of the blades of a bit rotated into a single rotated profile (i.e., in rotated profile view).

Conventional composite blade profile 39 (most clearly shown in the right half of bit 10 in FIG. 3) may generally be divided into three regions labeled cone region 24, shoulder region 25, and gage region 26. Cone region 24 comprises the radially innermost region of bit 10 and composite blade profile 39 extending generally from bit axis 11 to shoulder region 25. As shown in FIG. 3, in most conventional fixed cutter bits, cone region 24 is generally concave. Adjacent cone region 24 is shoulder (or the upturned curve) region 25. In most conventional fixed cutter bits, shoulder region 25 is generally convex. Moving radially outward, adjacent shoulder region 25 is the gage region 26 which extends parallel to bit axis 11 at the outer radial periphery of composite blade profile 39. Thus, composite blade profile 39 of conventional bit 10 includes one concave region (cone region 24), and one convex region (shoulder region 25).

The axially lowermost point of convex shoulder region 25 and composite blade profile 39 defines a blade profile nose 27. At blade profile nose 27, the slope of a tangent line 27*a* to convex shoulder region 25 and composite blade profile 39 is zero. Thus, as used herein, the term "blade profile nose" refers to the point along a convex region of a composite blade profile of a bit in rotated profile view at which the slope of a tangent to the composite blade profile is zero. For most conventional fixed cutter bits (e.g., bit 10), the composite blade profile includes a single convex shoulder region (e.g., convex shoulder region 25), and a single blade profile nose (e.g., nose 27). As shown in FIGS. 1-3, cutting elements 40 are arranged in rows along blades 31-36 and are positioned along the bit face 20 in the regions previously described as cone region 24, shoulder region 25 and gage region 26 of composite blade profile 39. In particular, cutting elements 40 are mounted on blades 31-36 in predetermined radially-spaced positions relative to the central axis 11 of the bit 10.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a downhole cutting tool that includes a tool body; at least one blade extending from the tool body; a plurality of cutting elements attached to the at least one blade, the plurality of cutting elements comprising at least two types of cutting elements on a first blade of the at least one blade, wherein the first blade extends from the tool body to a first height adjacent a first type of cutting element and a second height, different from the first height, adjacent a second type of cutting element.

In another aspect, embodiments disclosed herein relate to a downhole cutting tool, that includes a tool body; at least one blade extending from the tool body to a formation facing surface; a plurality of cutting elements attached to the at least one blade, the plurality of cutting elements comprising at least one cutter adjacent to at least one non-planar cutting element on a first blade of the at least one blade, wherein the first blade comprises at least one concave region and at least one convex region in the formation facing surface between the plurality of cutting elements.

A downhole cutting tool that includes a tool body; at least one blade extending from the tool body; a plurality of cutting elements attached to the at least one blade, the plurality of cutting elements comprising at least two of cutting elements having a substantially different orientation relative to a horizontal line on a first blade of the at least one blade, wherein the first blade extends from the tool body to a first height adjacent a first orientation of one of the at least two cutting elements and a second height, different from the first height, adjacent a second orientation of another of the at least two cutting elements.

Other aspects and advantages of the claimed subject matter will be apparent from the following description and the appended claims.

DETAILED DESCRIPTION

In one aspect, embodiments disclosed herein relate to drill bits or other downhole cutting tools containing multiple types of cutting structures. For example, embodiments disclosed herein relate to cutting tools containing two or more types of cutting elements, each type having a different mode of cutting action against a formation, including a combination of cutting elements having a non-planar cutting end with cutting elements having a planar cutting end and/or each having a different orientation on the tool relative to a line parallel to the tool axis. In one or more embodiments, the use of multiple types of cutting elements may be couple with a variable blade geometry proximate the cutting end of the cutting elements. Specifically, when using multiple types of cutting elements on a given blade, it may be desirable to having a different blade shape or relative location of the blade interfacing different types of cutting elements. Thus, one or more embodiments may relate to a downhole tool that includes an undulating blade surface proximate the cutting ends of a plurality of cutting elements (of differing types).

Figure 4:
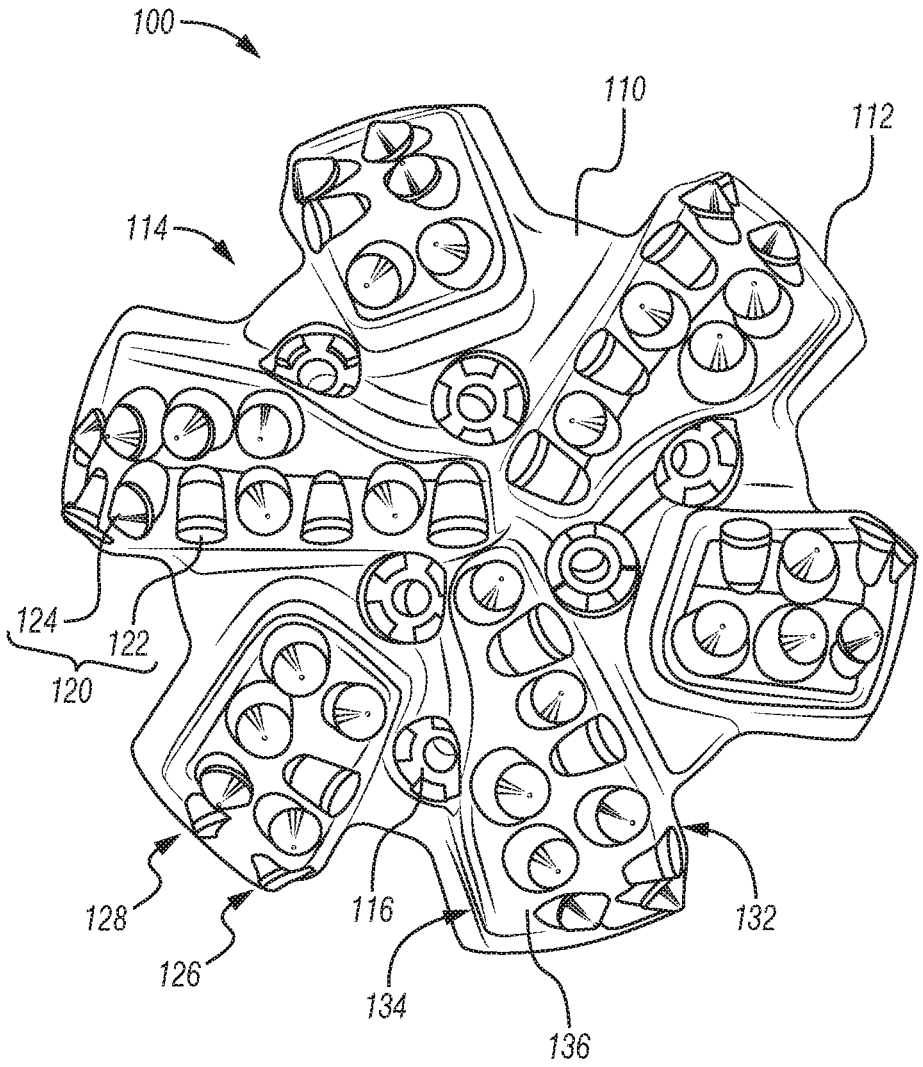
FIG. 4 shows a top view of a drill bit according to an embodiment of the present disclosure.
Figure 5:
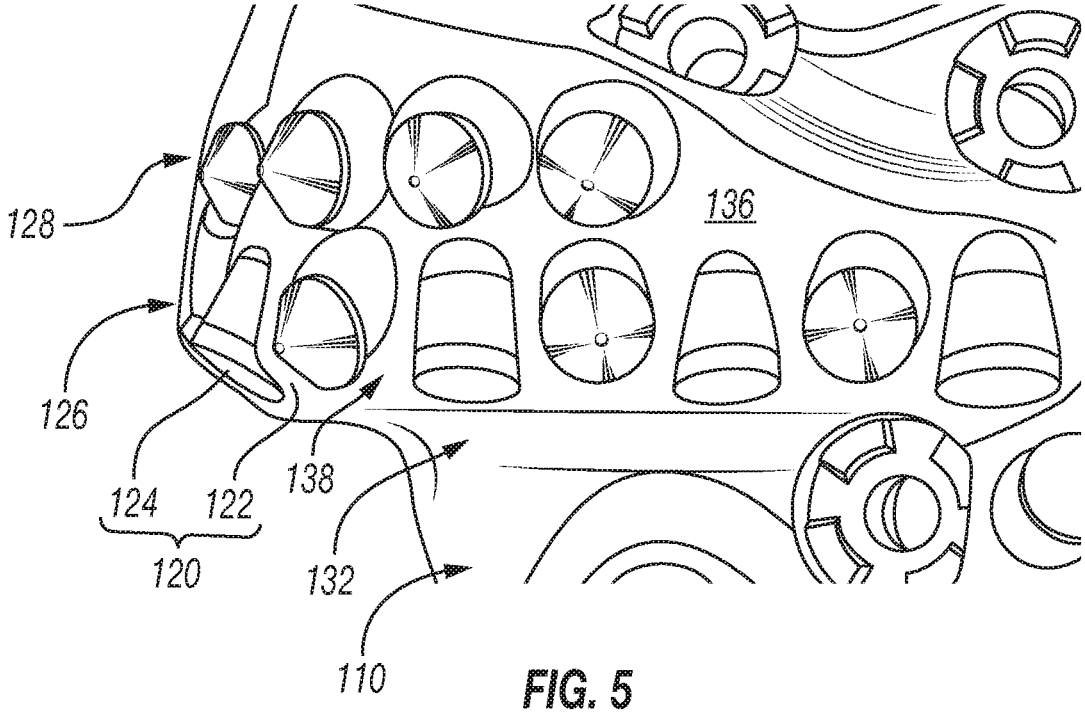
FIG. 5 shows a top view of a blade of the drill bit of FIG. 4
Figure 6:
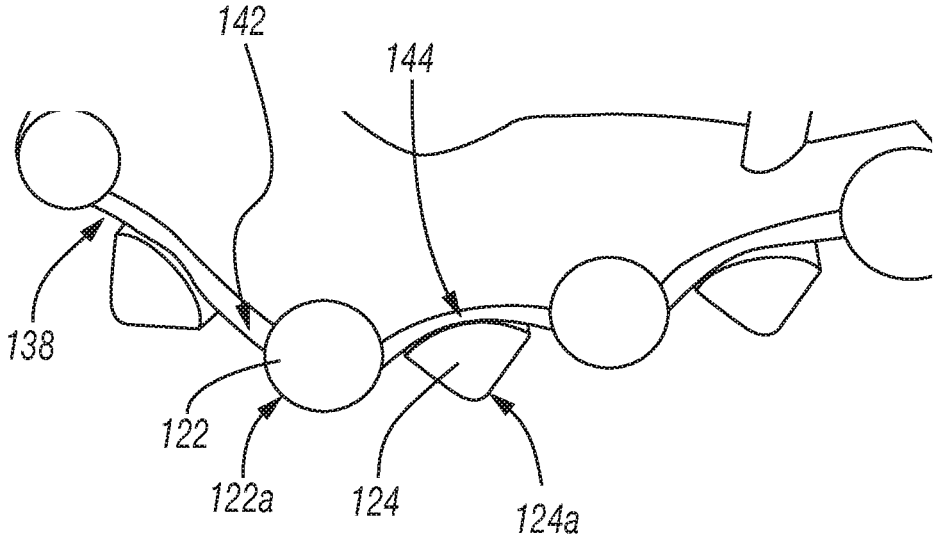
FIG. 6 shows a side view of a blade of the drill bit of FIG. 5.

Referring to FIGS. 4-6, a drill bit according to an embodiment of the present disclosure is shown. As shown, drill bit 100 includes a bit body 110 from which a plurality of blades 112 extend radially therefrom. Attached to blades 112 are a plurality of cutting elements 120. Between plurality of blades 112 are fluid channels 114 through which drilling fluid may flow (exiting nozzles 116 to cool and clean cutting elements 120). Cutting elements 120 include at least two different types: cutters 122 (having a planar cutting end) and non-planar cutting elements 124. Each blade 112 has a leading face 132 (facing in the direction of rotation of the drill bit 100), a trailing face 134 (opposite the leading face 132), and a formation-facing surface 136 (extending between the leading face 132 and trailing face 134). In addition to there being two types of cutting elements 120 (i.e., cutters 122 and non-planar cutting elements 124), the cutting elements 120 can be attached to blades 112 at different locations on a blade 112. For example, cutting elements 120 positioned on the formation facing surface 136 at or proximate the leading face 132 of the blade 112 may be referred to as primary cutting elements 126, whereas cutting elements 120 spaced rearward (away from the leading face 132) therefrom may be referred to as backup or secondary cutting elements 128.

Figure 3:
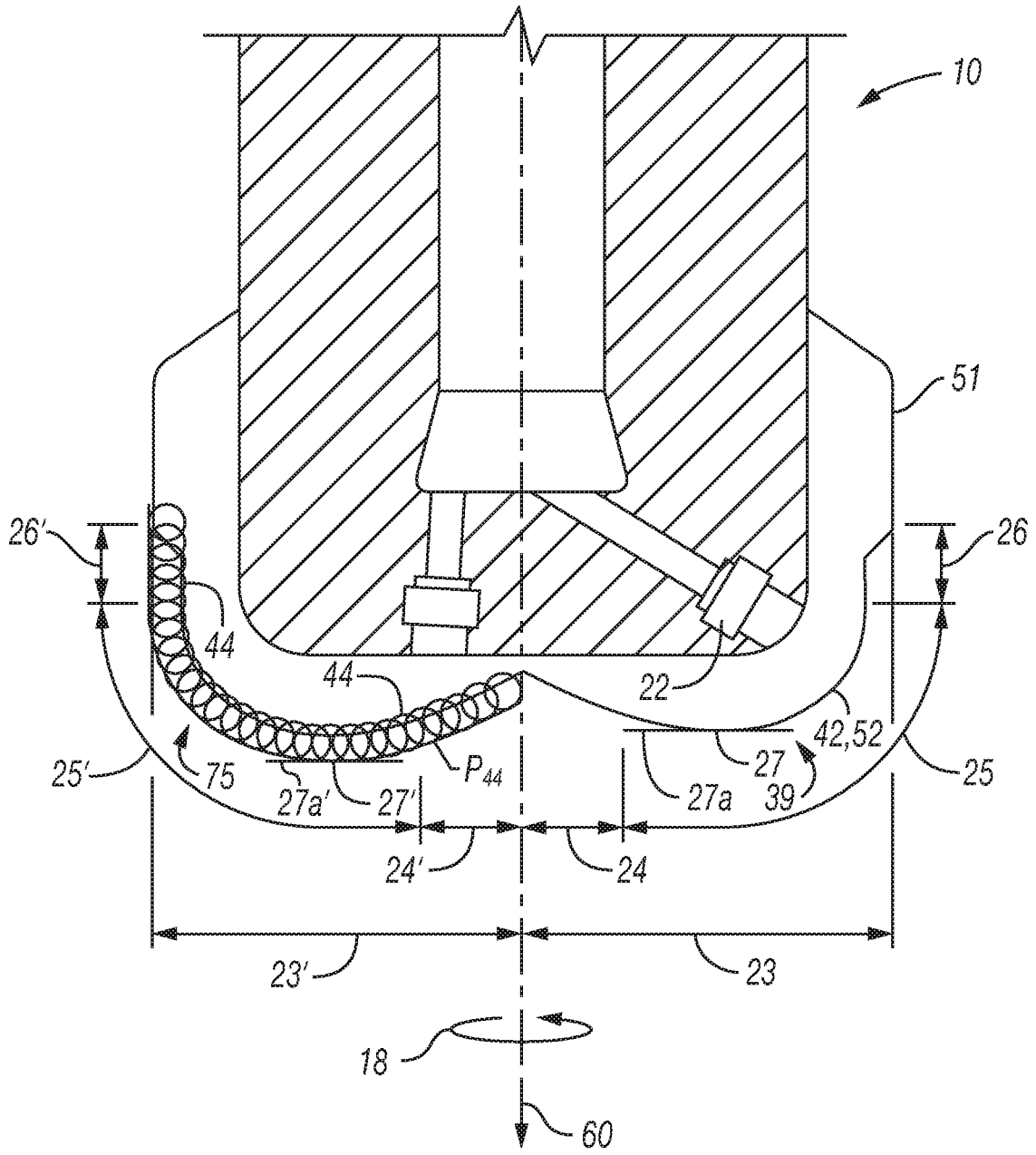
FIG. 3 (PRIOR ART)
FIG. 3 shows a cross-sectional view of a conventional drill bit.

In the illustrated embodiment, primary cutting elements 126 include both cutters 122 and non-planar cutting elements 124, and in particular, in an alternating arrangement extending radially outward. However, other embodiments may include other arrangements of the cutters 122 and non-planar cutting elements 124, where at least one cutter 122 on a given blade 112 is radially adjacent to at least one non-planar cutting element 124. By placing a cutter 122 radially adjacent on a given blade 112 to a non-planar cutting element 124, in accordance with embodiments of the present disclosure, the blade 112 may have a variable geometry between cutting elements 120. For example, the formation facing surface 136 may have a complex curvature, which is also apparent through an examination of the leading edge 138, i.e., the edge formed by the intersection of leading face 132 and formation facing surface 136. That is, in conventional fixed cutter bits with a cutting structure solely including cutters, the curvature of the formation facing surface (and/or leading edge) between cutters may substantially mimic the composite blade profile (shown in FIG. 3). Thus, if the conventional bit is oriented with the cutting elements facing down, the profile of a given blade is substantially smooth and concave in its totality. In contrast, in accordance with embodiments of the present disclosure, a given blade 112 having at least one cutter 122 and at least one non-planar cutting element 124 may have a complex curvature between the adjacent cutting elements 120 with at one convex region 144 and at least one concave region 142, particularly in the portion of the blade with neighboring cutters 122 and non-planar cutting elements 124. Depending on the arrangement of cutters 122 and non-planar cutting elements 124 on a blade 112, the formation facing surface 136 (and/or the leading edge 138) may have an undulating curvature, alternating between concave regions 142 and convex regions 144. In one or more embodiments, the formation facing surface 136 (and/or leading edge 138), adjacent a non-planar cutting element 124 may have a reduced height from the bit body 110, as compared to the height from bit body 110 to formation facing surface 136 (and/or leading edge 138) adjacent cutter 122. Such differences in height may create the complex curvature (such undulating) of formation facing surface 136 (and/or leading edge 138).

Figure 1:
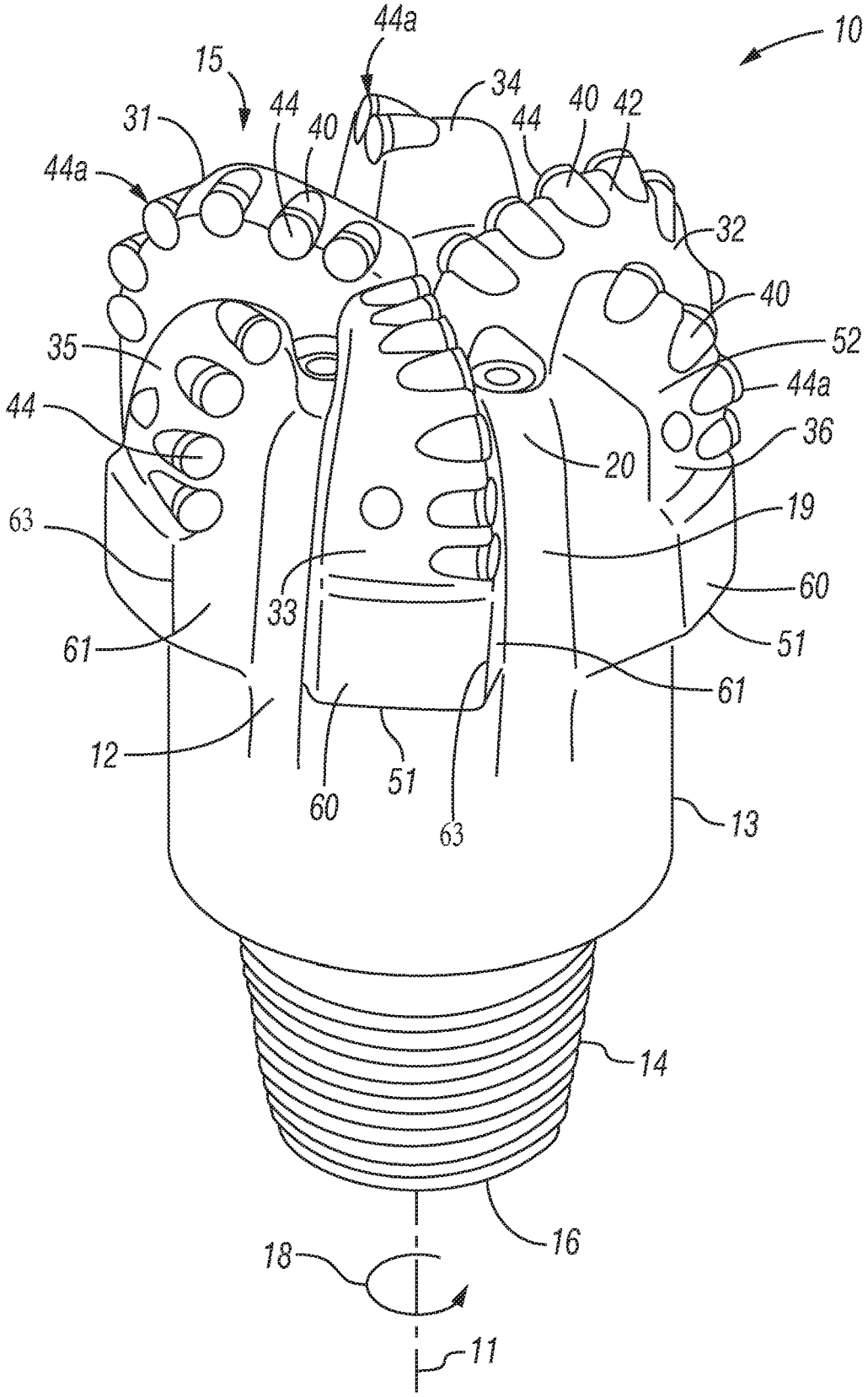
FIG. 1 (PRIOR ART)
FIG. 1 shows a conventional drill bit.

As shown in the views of FIGS. 4 and 5, between cutters 122 and non-planar cutting elements 124 as primary cutting elements 126, the cutters 122 on a given blade 122 are rotationally leading the non-planar cutting elements 124. That is, cutting face 122*a* of cutters 122 is rotationally ahead of the tip 124*a* of non-planar cutting element 124 and would pass through a radial line extending from the longitudinal axis L of the bit prior to the tip 124*a* of non-planar cutting element 124. Because non-planar cutting elements 124 are rotationally trailing as compared to cutters 122, the undulations in leading edge 138 are particularly apparent. Further, as shown, the non-planar cutting elements 124 are placed in a hole at an angle relative to the longitudinal axis (illustrated as 11 in FIG. 1) of the bit 100, whereas cutters 122 are placed in cutter pockets at a different angle relative to the longitudinal axis. Such orientation may be referred to as the rake angle, which is discussed below in greater detail. When, using such rotational offset between the cutting face 122*a* of cutters 122 and tip 124*a* of non-planar cutting element 124 on a given blade 112, as well as a difference in orientation of cutter 122 and non-planar cutting element, the use of a reduced height to formation facing surface 136 (and/or leading edge 138) adjacent non-planar cutting element 124, as compared to cutter 122, may beneficially allow for exposure of the diamond or other ultrahard material cutting end above the blade in which the non-planar cutting element 124 is embedded. Specifically, this difference may advantageously allow for spacing of the diamond cutting end away from the braze joint, which may reduce or even eliminate the formation of cracking in the diamond cutting end that can occur during the brazing process. In one or more embodiments, the diamond or other ultrahard material forming the cutting end of non-planar cutting element 124 may be spaced a distance of at least 0.03 inches (0.762 mm) away from the surrounding blade material. Additionally, the reduced height at the non-planar cutting element 124 may also advantageously allow for better cuttings removal away from the cutting element, as well as cross-flow of drilling fluid across the blade tops (formation facing surface 134), which may promote cleaning and cooling of the cutting structure as a whole.

Figure 7:
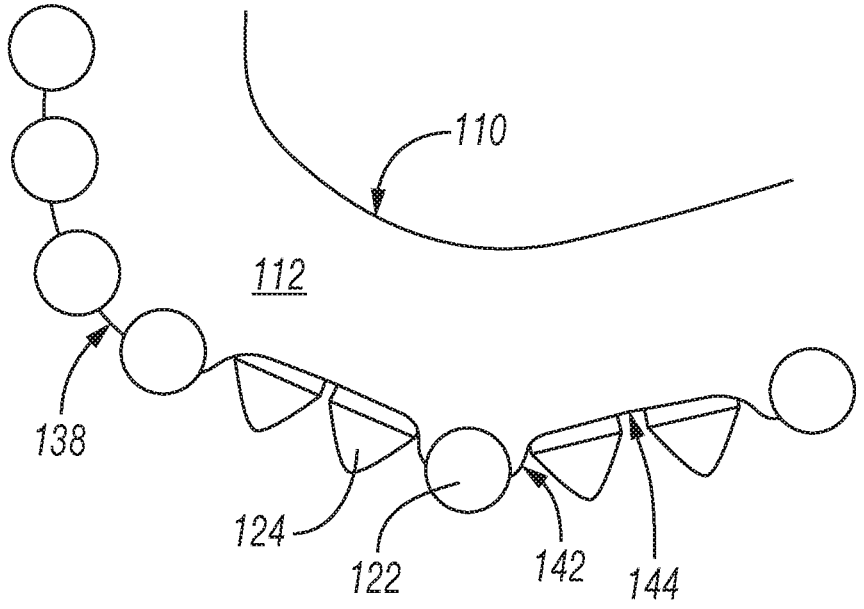
FIG. 7 shows a side view of a blade according to an embodiment of the present disclosure.

Referring now to FIG. 7, another embodiment of a cutting structure and blade geometry is shown. As shown in FIG. 7, instead of an alternating arrangement of cutters 122 and non-planar cutting elements 124 on a given blade 112, the cutting structure includes a plurality of non-planar cutting elements 124 side-by-side, at least one of which is adjacent to a cutter 122. While the cutters 122 and non-planar cutting elements 124 do not alternate, the formation facing surface 136 (and leading edge 138) still undulates between a concave region and a convex region in the transition between the different types of cutting elements. In this embodiment, the formation facing surface 136 (and/or leading edge 138) have a single continuous dip for the regions between and adjacent the side-by-side non-planar cutting elements 124.

Figure 8:
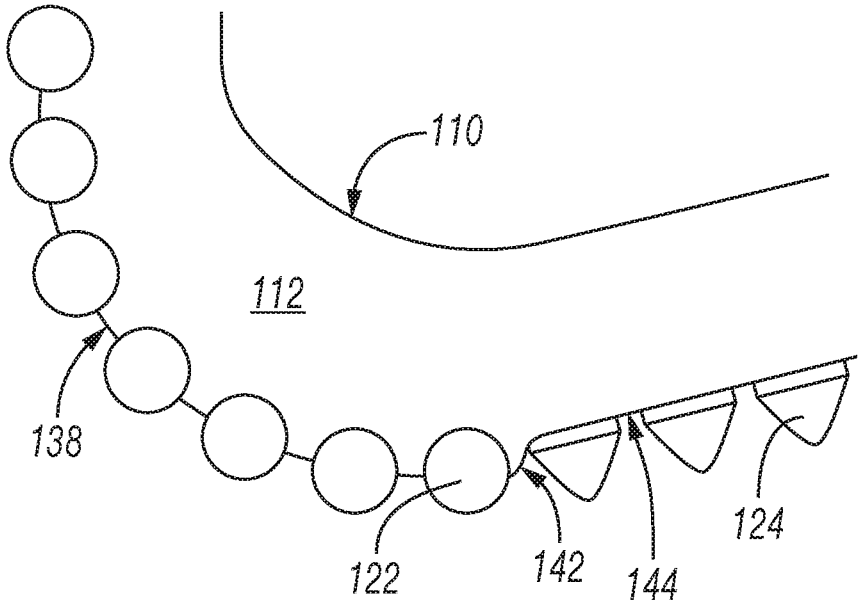
FIG. 8 shows a side view of a blade according to an embodiment of the present disclosure.

Another embodiment of a cutting structure and resulting blade geometry is shown in FIG. 8. As shown in FIG. 8, the non-planar cutting elements 122 are in the cone region of the cutting profile (as that term is defined above in FIG. 3), and the nose, shoulder, and gage regions include cutters 122. Due to the presence of a single transition between non-planar cutting elements 124 and cutters 122, the formation facing surface 136 (and/or leading edge 138) does not undulate, yet still possesses the complex curvature, with a convex region and a concave region, as well as the different heights to bit body 110. Further, while the above described embodiments describe the non-planar cutting elements 124 as rotationally trailing the cutters 122 on a given blade, the present disclosure is not so limited. Specifically, for example, when using non-planar cutting elements 124 in the cone region and cutters 122 in the radially outward portions of the blade 112, the non-planar cutting elements 124 may in fact be at the rotational position as cutters 122 (relative a radial line extending outward from longitudinal axis L). However, to provide sufficient blade material to surround and support the non-planar cutting elements 124, in such embodiment, the leading face 132 of a given blade 112 in the cone region may extend rotationally ahead of the portion of the blade 112 in the radially outward portions of the blade (i.e., nose, shoulder and gage). This change in the leading face 132 may also be present in other embodiments where the non-planar cutting elements and cutters are used in other arrangements (such as illustrated in FIGS. 4-7), if the cutters 122 do not rotationally lead the non-planar cutting elements 124.

While the above illustrated embodiments show the use of such complex curvature for primary cutting elements 126, and the use of cutters 122 alone as secondary cutting elements 128, it is also intended that secondary cutting elements may include cutters 122, non-planar cutting elements 124, or combinations thereof. When multiple types of cutting elements are used as back-up or secondary cutting elements 128 (i.e., combinations of cutters 122 and non-planar cutting elements 124), such complex curvature (as well as height difference between the formation facing surface 136 and bit body) may also be present on the formation facing surface 136 between the secondary cutting elements 128 of different types. Further, it is also intended that such multiple types of cutting elements 120 described above may be used for secondary cutting elements 128 but not primary cutting elements 126.

Figure 2:
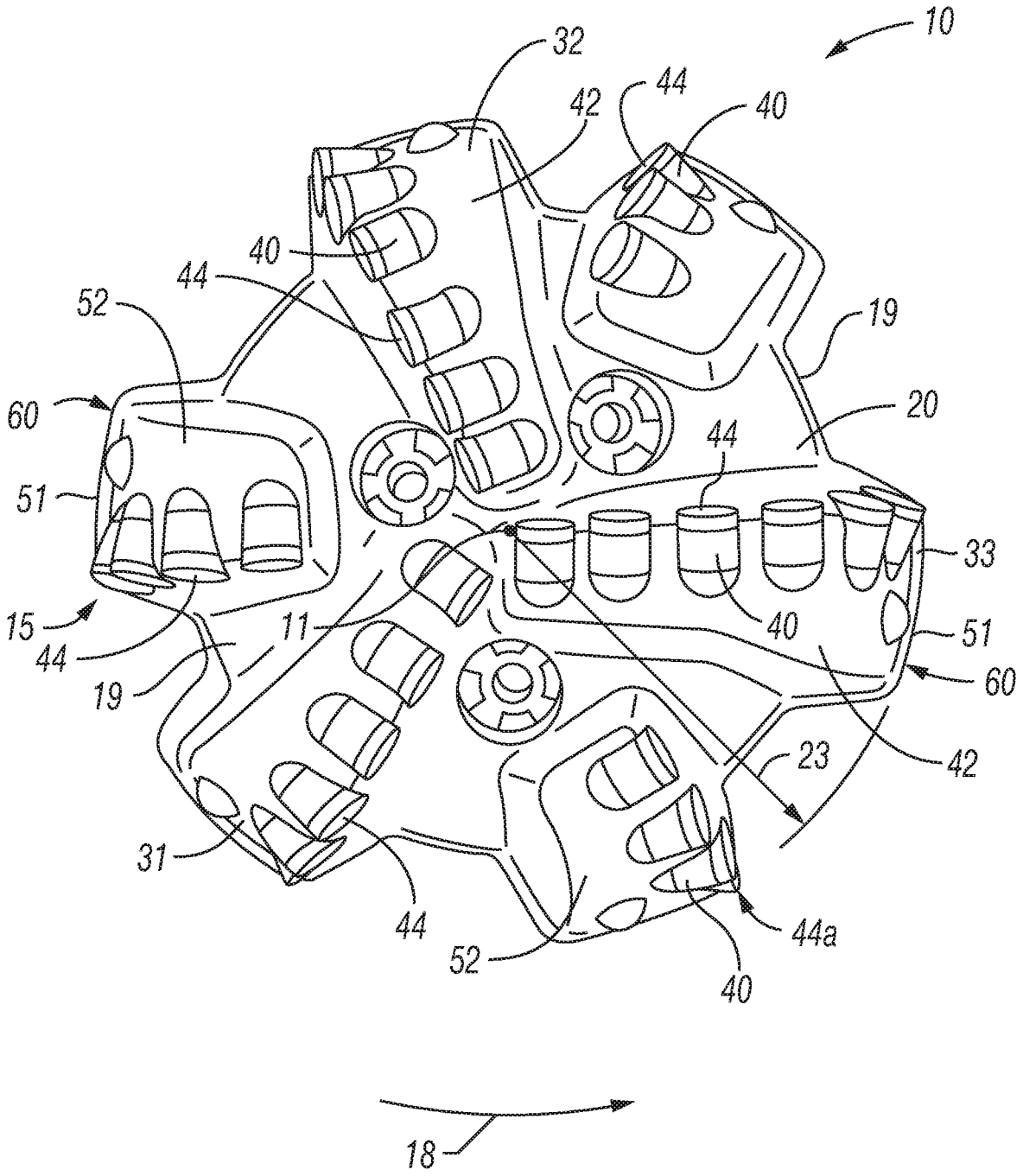
FIG. 2 (PRIOR ART)
FIG. 2 shows a top view of a conventional drill bit.

As used herein, "non-planar cutting elements" refers to cutting elements having a non-planar cutting end and may also be referred to as shaped cutting elements. The shape of the non-planar cutting end may include any geometric shape in which the portion of the cutting element that engages with the formation is not planar. Generally, a conventional cutter engages at the circumferential edge of the cylindrical compact and as the cutter cuts or digs into the formation, a portion of the planar cutting face engages with the formation. Such cutters may also generally include a beveled or chamfered edge; however, a substantial majority of the surface area of the cutting face is planar. However, such shapes are not within the scope of the "non-planar cutting elements" as that term is defined herein. Rather, a non-planar cutting element possesses a height extension above the transition from the cylindrical side surface and the cutting end, and a substantial majority of the cutting end is non-planar. Such shapes may include generally pointed cutting elements, domed cutting elements, and cutting elements having a parabolic cutting end (i.e., having a substantially parabolic cross-sectional upper surface, such as a cutting element with a hyperbolic parabaloid or parabolic cylinder shaped cutting end). Generally pointed cutting elements may have generally pointed cutting end, i.e., terminating in an apex, with a conical, convex, or concave side surfaces, shown in FIGS. 9-11. However, the present disclosure may also apply to cutting elements with other shaped non-planar cutting ends as well as shaped cutting elements. As used herein, the term "shaped cutting element" refers to a non-cylindrical cutting end above a transition from the cylindrical side surface. Such non-cylindrical cutting end may have a varying cross-sectional geometry or size along the height of the cutting end, or at least, as compared to the substrate. For ease in distinguishing between the types of cutting elements, the term "cutting elements" will generically refer to any type of cutting element, while "cutter" will refer those cutting elements with a planar cutting face, as described above in reference to FIGS. 1 and 2, "non-planar cutting element" will refer to those cutting elements having a non-planar cutting end, and "shaped cutting elements" will refer to those cuttings having a non-uniform and non-cylindrical cutting end.

Figure 9:
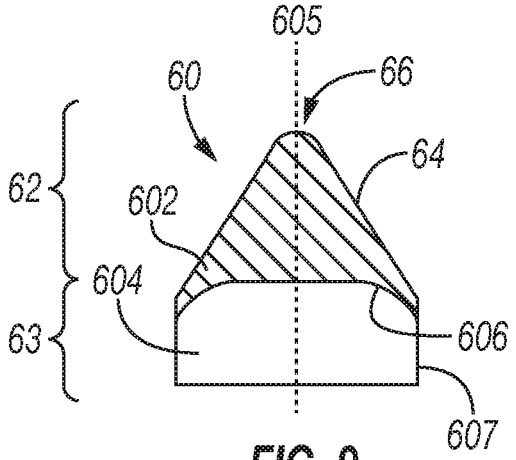
FIG. 9 shows an embodiment of a non-planar cutting element according to the present disclosure.

In one or more embodiments, the non-planar cutting element 607, 707, 807 may have a generally conical cutting end 62 (including either right cones or oblique cones), i.e., a conical side wall 64 that terminates in a rounded apex 66 along an axis 605, as shown in FIG. 9. Unlike geometric cones that terminate at a sharp point apex, the conical cutting elements of the present disclosure possess an apex having curvature between the side surfaces and the apex.

Figure 10:
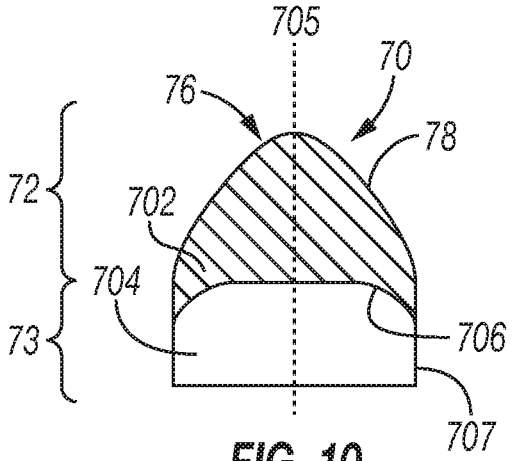
FIG. 10 shows an embodiment of a non-planar cutting element according to the present disclosure.
Figure 11:
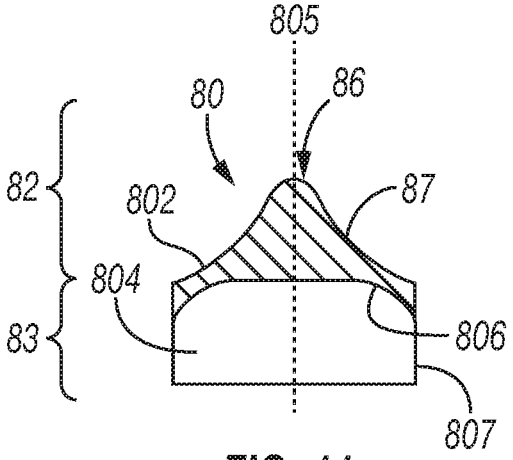
FIG. 11 shows an embodiment of a non-planar cutting element according to the present disclosure.

Further, in one or more embodiments, a bullet cutting element 70 may be used. The term "bullet cutting element" refers to cutting element having, instead of a generally conical side surface, a generally convex side surface 78 terminated in a rounded apex 76 along an axis 705, as shown in FIG. 10. In one or more embodiments, the apex 76 has a substantially smaller radius of curvature than the convex side surface 78. However, it is also intended that the non-planar cutting elements of the present disclosure may also include other shapes, including, for example, a pointed geometry 80 having a concave side surface 87 terminating in a rounded apex 86 along an axis 805, as shown in FIG. 11. In each of such embodiments, the non-planar cutting elements may have a smooth transition between the side surface and the rounded apex (i.e., the side surface or side wall tangentially joins the curvature of the apex), but in some embodiments, a non-smooth transition may be present (i.e., the tangent of the side surface intersects the tangent of the apex at a non-180 degree angle, such as for example ranging from about 120 to less than 180 degrees). Further, in one or more embodiments, the non-planar cutting elements may include any shape having a cutting end 62, 72, 82 extending above a grip or base region 63, 73, 83, where the cutting end extends a height that is at least 0.25 times the diameter of the cutting element, or at least 0.3, 0.4, 0.5 or 0.6 times the diameter in one or more other embodiments.

In one or more embodiments, non-planar cutting elements may have a diamond layer on a substrate 604, 704, 804 (such as a cemented tungsten carbide substrate), where the diamond layer 602, 702, 802 forms a non-planar diamond working surface. However, non-planar cutting elements may be made of other materials, as it is their shape and not material that defines the cutting elements. For example, the conical geometry may comprise a side wall that tangentially joins the curvature of the apex. Non-planar cutting elements 18 may be formed in a process similar to that used in forming diamond enhanced inserts (used in roller cone bits) or by brazing of components together. The interface 606, 706, 806 between diamond layer and substrate may be non-planar or non-uniform, for example, to aid in reducing incidents of delamination of the diamond layer from substrate when in operation and to improve the strength and impact resistance of the element. One skilled in the art would appreciate that the interface may include one or more convex or concave portions, as known in the art of non-planar interfaces. Additionally, one skilled in the art would appreciate that use of some non-planar interfaces may allow for greater thickness in the diamond layer in the tip region of the layer. Further, it may be desirable to create the interface geometry such that the diamond layer is thickest at a zone that encompasses the primary contact zone between the diamond enhanced element and the formation.

Additional shapes and interfaces that may be used for substantially pointed cutting elements of the present disclosure include those described in U.S. Patent Publication No. 2008/0035380, which is herein incorporated by reference in its entirety. Further, the diamond layer may be formed from any polycrystalline superabrasive material, including, for example, polycrystalline diamond, polycrystalline cubic boron nitride, thermally stable polycrystalline diamond (formed either by treatment of polycrystalline diamond formed from a metal such as cobalt or polycrystalline diamond formed with a metal having a lower coefficient of thermal expansion than cobalt).

The apex of the non-planar cutting element may have curvature, including a radius of curvature. In the embodiments shown in FIGS. 9-11, the radius of curvature may range from about 0.050 to 0.125. In some embodiments, the curvature may comprise a variable radius of curvature, a portion of a parabola, a portion of a hyperbola, a portion of a catenary, or a parametric spline. Further, referring to FIGS. 9 and 10, the cone angle of the conical end may vary, and be selected based on the particular formation to be drilled. In a particular embodiment, the cone angle may range from about 75 to 90 degrees.

Other designs of conical cutting elements may be used in embodiments of the present disclosure, such as described in, for example, U.S. Patent Application No. 61/441,319, U.S. patent application Ser. No. 13/370,734, U.S. Patent Application No. 61/499,851, U.S. patent application Ser. No. 13/370,862, and U.S. Patent Application No. 61/609,527, each of which is assigned to the present assignee and herein incorporated by reference in its entirety.

Further, any of the cutting elements of the present disclosure may be attached to a bit or other downhole cutting tool by methods known in the art, such as brazing, or may be rotatably retained on the downhole tool. For example, a cutting element may be rotatably retained on a downhole tool by one or more retention mechanisms, such as by retention balls, springs, pins, etc. In one or more embodiments, a non-planar cutting element may be rotatably retained in a pocket formed in a blade of a downhole tool, such as drill bit or reamer, using a plurality of retention balls disposed between corresponding grooves formed around the outer side surface of the conical cutting element body and the inner side surface of a sleeve, which is attached to the pocket. In other embodiments, a non-planar cutting element may be rotatably retained in a pocket formed in a blade of a downhole tool using changes in the non-planar cutting element body's diameter. For example, a non-planar cutting element body or substrate may have a first diameter proximate to the non-planar cutting end and a second diameter axially distant from the non-planar cutting end, wherein the second diameter is larger than the first diameter. A sleeve surrounding the non-planar cutting element body (which may be attached to a pocket) or the pocket may have a first inner diameter corresponding with the first diameter of the non-planar cutting element. Thus, when the cutting element is assembled within the corresponding sleeve or pocket, the larger second diameter retains the cutting element. Various examples of retention mechanisms also include those disclosed in U.S. Patent Publication Nos. 2012/0132471, 2014/0054094 and U.S. Pat. Nos. 7,703,559 and 8,091,655, all of which are assigned to the present assignee and herein incorporated by reference in their entirety.

Figure 12:
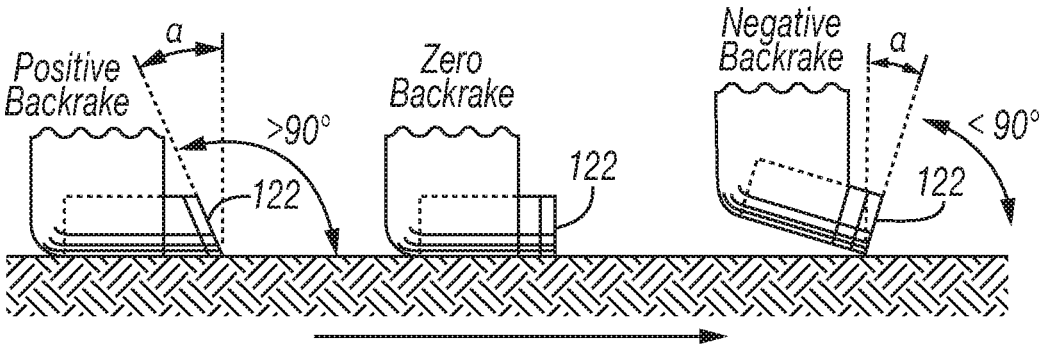
FIG. 12 shows backrake angles for conventional cutting elements.

As mentioned above, in one or more embodiments, the longitudinal axis of cutters 122 and non-planar cutting elements 124 may be oriented at differing angles relative to the longitudinal axis L of the bit. Generally, when positioning cutting elements (specifically cutters) on a blade of a bit or reamer, the cutters may be inserted into cutter pockets (or holes in the case of non-planar cutting elements) to change the angle at which the cutter strikes the formation. Specifically, the back rake (i.e., a vertical orientation) and the side rake (i.e., a lateral orientation) of a cutter may be adjusted. Generally, back rake is defined as the angle $\alpha$ formed between the cutting face of the cutter 122 and a line that is normal to the formation material being cut. As shown in FIG. 12, with a conventional cutter 122 having zero backrake, the cutting face 122*a* is substantially perpendicular or normal to the formation material. A cutter 122 having negative backrake angle $\alpha$ has a cutting face 122*a* that engages the formation material at an angle that is less than 90° as measured from the formation material. Similarly, a cutter 142 having a positive backrake angle $\alpha$ has a cutting face 122*a* that engages the formation material at an angle that is greater than 90° when measured from the formation material. Side rake is defined as the angle between the cutting face and the radial plane of the bit (x-z plane). When viewed along the z-axis, a negative side rake results from counterclockwise rotation of the cutter, and a positive side rake, from clockwise rotation. In a particular embodiment, the backrake of the conventional cutters may range from −5 to −45, and the side rake from 0-30.

Figure 13:
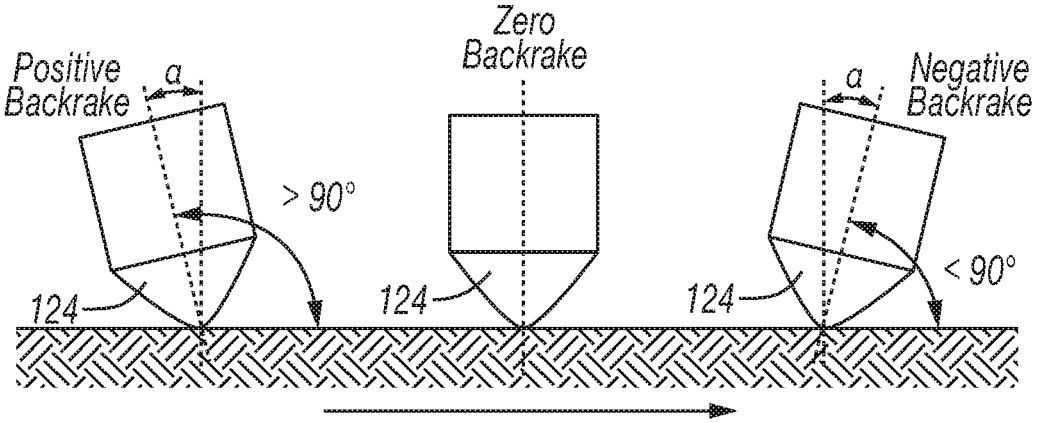
FIG. 13 shows backrake angles for conical cutting elements according to the present disclosure.

However, non-planar cutting elements do not have a cutting face and thus the orientation of non-planar cutting elements is defined differently. When considering the orientation of non-planar cutting elements, in addition to the vertical or lateral orientation of the cutting element body, the geometry of the cutting end also affects how and the angle at which the non-planar cutting element strikes the formation. Specifically, in addition to the backrake affecting the aggressiveness of the non-planar cutting element-formation interaction, the cutting end geometry (specifically, the apex angle and radius of curvature) greatly affect the aggressiveness that a non-planar cutting element attacks the formation. In the context of a conical cutting element, as shown in FIG. 13, backrake is defined as the angle $\alpha$ formed between the axis of the conical cutting element 124 (specifically, the axis of the conical cutting end) and a line that is normal to the formation material being cut. As shown in FIG. 13, with a conical cutting element 124 having zero backrake, the axis of the conical cutting element 124 is substantially perpendicular or normal to the formation material. A conical cutting element 124 having negative backrake angle $\alpha$ has an axis that engages the formation material at an angle that is less than 90° as measured from the formation material. Similarly, a conical cutting element 124 having a positive backrake angle $\alpha$ has an axis that engages the formation material at an angle that is greater than 90° when measured from the formation material. In a particular embodiment, the backrake angle of the conical cutting elements may be zero, or in another embodiment may be negative. In a particular embodiment, the backrake of the non-planar cutting elements may range from −35 to 35 degrees, from −20 to 20 degrees, −10 to 10 degrees, from 0 to 10 degrees in a particular embodiment, and from −5 to 5 degrees in an another embodiment. Additionally, the side rake of the conical cutting elements may range from about −10 to 10 degrees in various embodiments. As mentioned above, the back rake angles for the non-planar cutting elements and cutters are defined differently (angle between axis of cutting element and longitudinal line for non-planar cutting elements and angle between cutting face and longitudinal line for cutter). However, in accordance with one or more embodiments of the present disclosure, the angle difference between the longitudinal axes of the two (or more) different types of cutting elements may range, for example, between 20 and 85 degrees (which may be considered by looking at the axis of the two elements and a horizontal line). In one or more embodiments, such angle range may be any of a lower limit of 20, 25, 30, 35, 40, 50, or 60 degrees, and an upper limit of 85, 80, 75, 70, 65, 55, or 45 degrees, where any lower limit may be used with any upper limit. The undulations of the blade (or other complex curvature) may be used with any two cutting elements on a given blade having a substantially different orientation of their longitudinal axes relative to a horizontal line, even if the two cutting elements are of the same type.

Figure 14:
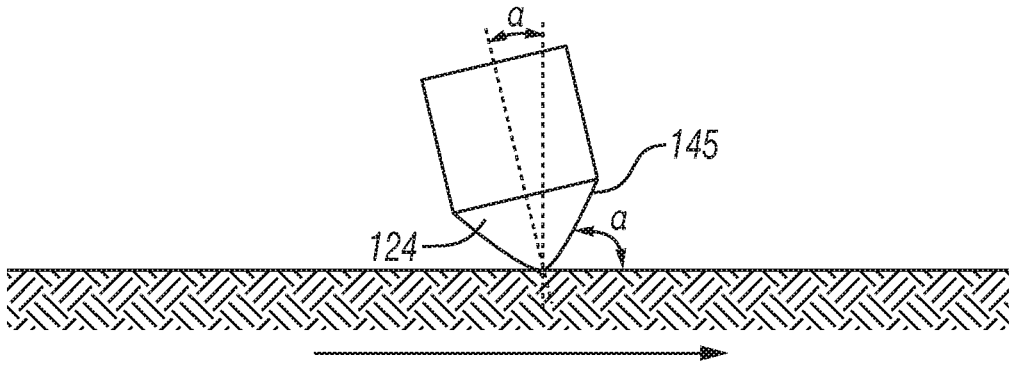
FIG. 14 shows strike angles for conical cutting elements of the present disclosure.

In addition to the orientation of the axis with respect to the formation, the aggressiveness of the conical cutting elements may also be dependent on the apex angle or specifically, the angle between the formation and the leading portion of the conical cutting element. Because of the conical shape of the conical cutting elements, there does not exist a leading edge; however, the leading line of a conical cutting surface may be determined to be the first most points of the conical cutting element at each axial point along the conical cutting end surface as the bit rotates. Said in another way, a cross-section may be taken of a conical cutting element along a plane in the direction of the rotation of the bit, as shown in FIG. 14. The leading line 145 of the conical cutting element 124 in such plane may be considered in relation to the formation. The strike angle of a conical cutting element 124 is defined to be the angle $\alpha$ formed between the leading line 145 of the conical cutting element 124 and the formation being cut. The strike angle will vary depending on the backrake and the cone angle, and thus, the strike angle of the conical cutting element may be calculated to be the backrake angle less one-half of the cone angle (i.e., $\alpha$=BR−(0.5*cone angle)).

Figure 15:
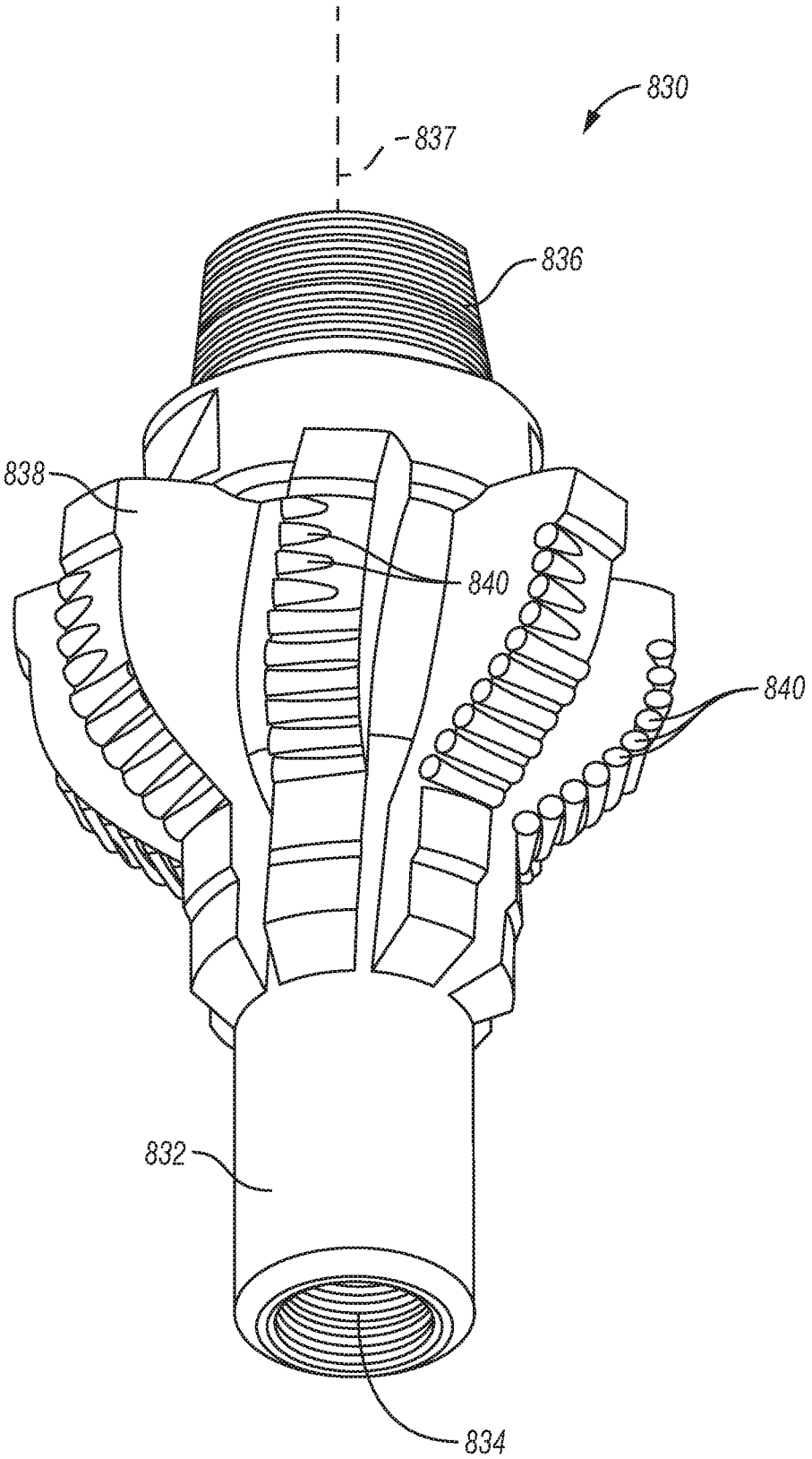
FIG. 15 shows a tool that may use the cutting elements of the present disclosure.

As described throughout the present disclosure, the cutting elements and cutting structure combinations may be used on either a fixed cutter drill bit or hole opener. FIG. 15 shows a general configuration of a hole opener 830 that includes the cutting elements and blade geometry of the present disclosure. The hole opener 830 includes a tool body 832 and a plurality of blades 838 disposed at selected azimuthal locations about a circumference thereof. The hole opener 830 generally includes connections 834, 836 (e.g., threaded connections) so that the hole opener 830 may be coupled to adjacent drilling tools that comprise, for example, a drillstring and/or bottom hole assembly (BHA) (not shown). The tool body 832 generally includes a bore therethrough so that drilling fluid may flow through the hole opener 830 as it is pumped from the surface (e.g., from surface mud pumps (not shown)) to a bottom of the wellbore (not shown). The tool body 832 may be formed from steel or from other materials known in the art. For example, the tool body 832 may also be formed from a matrix material infiltrated with a binder alloy.

The blades 838 shown in FIG. 15 are spiral blades and are generally positioned at substantially equal angular intervals about the perimeter of the tool body so that the hole opener 830. This arrangement is not a limitation on the scope of the invention, but rather is used merely to illustrative purposes. Those having ordinary skill in the art will recognize that any downhole cutting tool may be used. While FIG. 14 does not detail the location of the different types cutting elements, their placement on the tool may be according to all the variations described above.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. A downhole cutting tool, comprising:

a tool body;

at least one blade extending from the tool body, the at least one blade comprising a leading edge and a formation facing surface; and a plurality of cutting elements attached to the at least one blade, the plurality of cutting elements comprising a plurality of primary cutting elements attached to the at least one blade proximate the leading edge, the plurality of primary cutting elements including:

a first cutting element oriented in a first orientation, the first cutting element having an ultrahard portion, at least a portion of which is within the formation facing surface of the at least one blade; and a second cutting element oriented in a second direction that is substantially different than the first orientation, the second cutting element comprising the second cutting element having an ultrahard portion, a full portion of which is elevated from the formation facing surface of the at least one blade wherein the formation facing surface of the at least one blade between the first cutting element and the second cutting element comprises a complex curvature.

2. The downhole cutting tool of claim 1, the at least one blade having a first height adjacent the first cutting element and a second height that is different than the first height, adjacent the second cutting element.

3. The downhole cutting tool of claim 2, the first and second heights being measured as a distance between the bit body and the leading edge of the at least one blade.

4. The downhole cutting tool of claim 2, the first and second heights being measured as a distance between the bit body and the formation facing surface of the at least one blade.

5. The downhole cutting tool of claim 1, the formation facing surface of the at least one blade adjacent the first cutting element being concave and the formation facing surface of the at least one blade adjacent the second cutting element being convex.

6. The downhole cutting tool of claim 1, the plurality of cutting elements defining a composite cutting profile, and the formation facing surface of the at least one blade not substantially mimicking the composite cutting profile.

7. The downhole cutting tool of claim 6, the composite cutting profile being smooth and concave.

8. The downhole cutting tool of claim 1, the ultrahard portion of the first cutting element including a planar cutting face facing a direction of rotation of the tool body, and the ultrahard portion of the second cutting element including a non-planar cutting face having a tip facing outwardly from the formation facing surface of the at least one blade.

9. The downhole cutting tool of claim 1, the second cutting element including a substrate coupled to the ultrahard portion of the second cutting element, an interface between the substrate and the ultrahard portion being exposed above the formation facing surface of the at least one blade.

10. The downhole cutting tool of claim 1, the first cutting element and the second cutting element each have a longitudinal axis that is oriented at an angle relative to a longitudinal axis of the bit body, the angle of the longitudinal axis of the first cutting element relative to the longitudinal axis of the bit body being larger than the angle of the longitudinal axis of the second cutting element relative to the longitudinal axis of the bit body.

11. The downhole cutting tool of claim 1, the second cutting element being coupled to the at least one blade with a braze joint, the ultrahard portion of the second cutting element being spaced from the braze joint.

12. The downhole cutting tool of claim 11, the ultrahard portion being spaced at least 0.03 in. (0.762 mm) from the braze joint.

* * * * *